US011524199B2

(12) United States Patent
Reilly et al.

(10) Patent No.: US 11,524,199 B2
(45) Date of Patent: Dec. 13, 2022

(54) RESISTANCE TRAINING EQUIPMENT

(71) Applicants: Roderick Reilly, Alexandria, VA (US); Zane Esche, Alexandria, VA (US)

(72) Inventors: Roderick Reilly, Alexandria, VA (US); Zane Esche, Alexandria, VA (US)

( * ) Notice: Subject to any disclaimer, the term of this patent is extended or adjusted under 35 U.S.C. 154(b) by 0 days.

(21) Appl. No.: 16/601,007

(22) Filed: Oct. 14, 2019

(65) Prior Publication Data

US 2021/0106865 A1 Apr. 15, 2021

(51) Int. Cl.
*A63B 21/04* (2006.01)
*A63B 21/08* (2006.01)
*A63B 21/055* (2006.01)

(52) U.S. Cl.
CPC ..... *A63B 21/0442* (2013.01); *A63B 21/0557* (2013.01); *A63B 21/08* (2013.01)

(58) Field of Classification Search
CPC ..... A63B 21/02; A63B 21/04; A63B 21/0442; A63B 21/0557; A63B 21/08
See application file for complete search history.

(56) References Cited

U.S. PATENT DOCUMENTS 3,636,946 A * 1/1972 Hardy ..... A63B 21/04 601/28
4,787,630 A 11/1988 Watson et al.
4,822,039 A * 4/1989 Gonzales ..... A63B 21/04 482/128
5,529,562 A * 6/1996 Glaser ..... A63B 21/154 482/123
6,558,301 B1 * 5/2003 Jackson ..... A63B 21/0552 482/121
6,908,417 B2 6/2005 Jackson
7,488,282 B2 2/2009 Leavitt
7,601,101 B2 10/2009 Jackson et al.
8,721,507 B2 5/2014 Blancher
2005/0107226 A1 * 5/2005 Monda ..... A63B 21/04 482/121
2006/0052220 A1 * 3/2006 Jackson ..... A63B 21/04 482/52
2006/0128540 A1 * 6/2006 Engle ..... A63B 21/04 482/123
2006/0199706 A1 * 9/2006 Wehrell ..... A63B 21/4019 482/92
2008/0113852 A1 * 5/2008 Caldwell ..... A63B 23/03541 482/133
2013/0079203 A1 * 3/2013 Jones ..... A63B 21/4013 482/130

(Continued)

*Primary Examiner* — Jennifer Robertson

(57) ABSTRACT

A hex flex apparatus for improving resistance training is presented. The hex flex apparatus is useful for providing more than the standard two-dimension experience, in that a standard apparatus requires large jumps in band size and resistance to move up to the next level. The hex flex apparatus further adds a third dimension by allowing for smaller, more gradual increments to resistance, which leads to more and steadier strength progress before reaching a plateau or sticking point. A platform with two handles is described as is the band which is used to provide tension for resistance training. Further adjustable rods are shown which can be placed into various holes to control the tension and the rods have a ring magnet which provides for the rods being secured in the holes. The bands are further around the rods to access the value of the rods.

20 Claims, 3 Drawing Sheets

(56) References Cited

U.S. PATENT DOCUMENTS

| | | | | |
|---|---|---|---|---|
| 2013/0225372 | A1* | 8/2013 | Rochford | A63B 21/0442 482/38 |
| 2014/0155232 | A1* | 6/2014 | Wolan | A63B 21/4033 482/123 |
| 2015/0099613 | A1* | 4/2015 | Munoz Saez | A63B 21/16 482/139 |
| 2016/0144217 | A1* | 5/2016 | Oltorik, Jr. | A63B 23/03525 482/130 |
| 2018/0207470 | A1* | 7/2018 | Duffy | A63B 23/0405 |
| 2018/0290002 | A1 | 10/2018 | Colangelo | |
| 2019/0060695 | A1* | 2/2019 | Weisz | A63B 21/0557 |
| 2019/0308066 | A1* | 10/2019 | Rusch | A63B 23/0211 |
| 2020/0023229 | A1* | 1/2020 | Oltorik | A63B 1/00 |
| 2021/0060377 | A1* | 3/2021 | Mesko | A63B 24/0062 |

* cited by examiner

RESISTANCE TRAINING EQUIPMENT

FIELD OF THE INVENTION

This invention relates to resistance training. More particularly, it relates to a device to improve resistance training.

BACKGROUND

Resistance training is a common type of strength training for developing the strength and size of skeletal muscles. It utilizes the force of gravity in the form of weighted bars, dumbbells or weight stacks in order to oppose the force generated by muscle through concentric or eccentric contraction. Resistance training uses a variety of specialized equipment to target specific muscle groups and types of movement.

Sports where strength training is central are bodybuilding, weightlifting, power-lifting, strongman highland games, hammer throw, shot put, discus throw and javelin throw.

Resistance training is primarily an isotonic form of exercise, as the force produced by the muscle to push or pull weighted objects should not change (though in practice the force produced does decrease as muscles fatigue). Any object can be used for Resistance Training, but dumbbells, handles, and other specialized equipment are normally used because they can be adjusted to specific weights and are easily gripped. Many exercises are not strictly isotonic because the force on the muscle varies as the joint moves through its range of motion. Movements can become easier or harder depending on the angle of muscular force relative to gravity; for example, a standard biceps curl becomes easier as the hand approaches the shoulder as more of the load is taken by the structure of the elbow. Some machines use a logarithmic-spiral cam to keep resistance constant irrespective of the joint angle.

Plyometrics exploit the stretch-shortening cycle of muscles to enhance the myotatic (stretch) reflex. This involves rapid alternation of lengthening and shortening of muscle fibers against resistance. The resistance involved is often a weighted object such as a medicine ball or sandbag, but can also be the body itself as in jumping exercises or the body with a weight vest that allows movement with resistance.

Plyometrics is used to develop explosive speed, and focuses on maximal power instead of maximal strength by compressing the force of muscular contraction into as short a period as possible, and may be used to improve the effectiveness of a boxer's punch, or to increase the vertical jumping ability of a basketball player. Care must be taken when performing plyometric exercises because they inflict greater stress upon the involved joints and tendons than other forms of exercise.

Bar bells and other weight equipment is bulky and heavy causing the storage and use to be detrimental to those wanting to lift weights. Therefore, there is a need to provide an apparatus to allow the use and storage of resistance training equipment while not jeopardizing the benefits obtained from resistance training.

DETAILED DESCRIPTION

Figure 1:
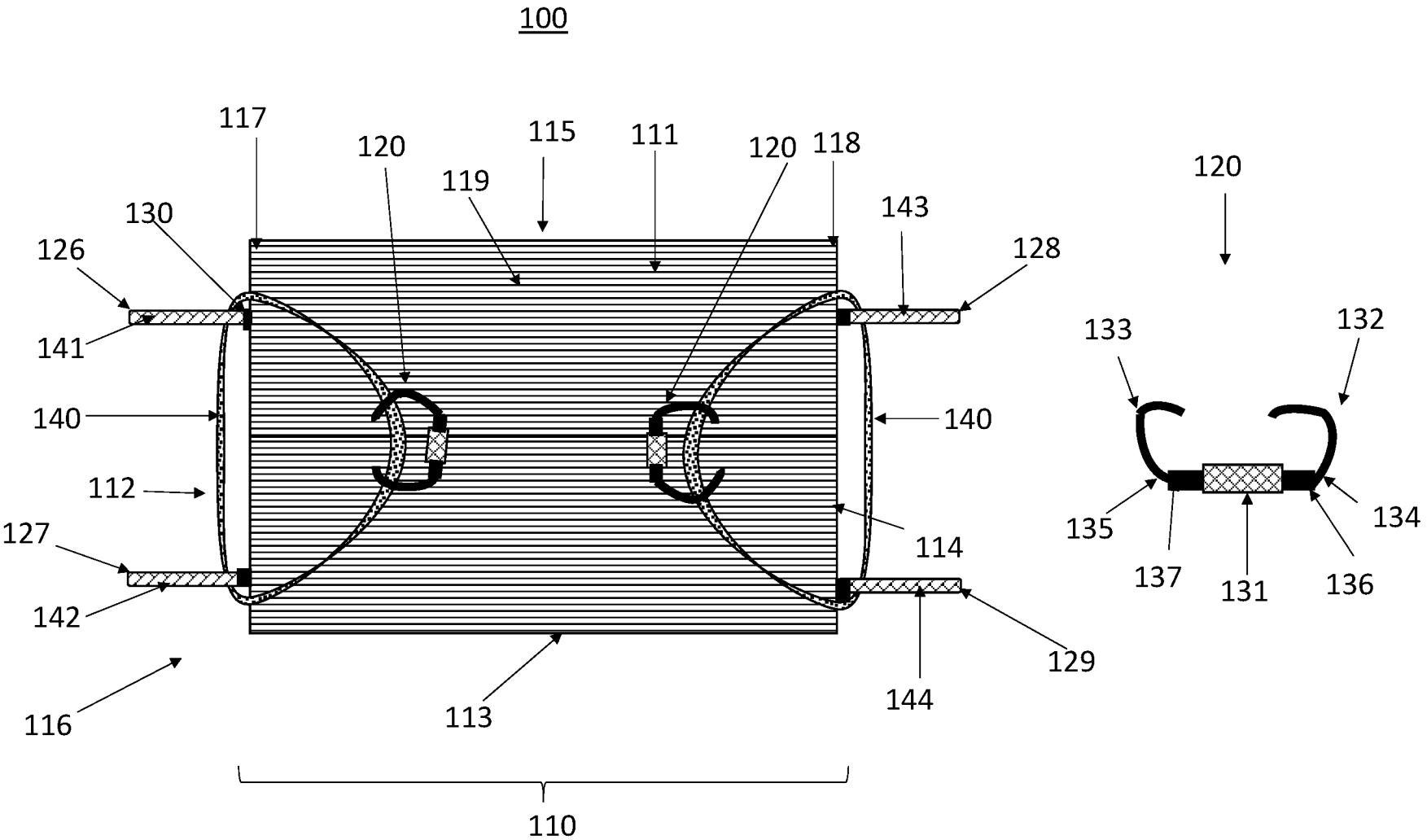
FIG. 1 is an illustrated top view of an exemplary hex flex apparatus.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Referring to FIG. 1, an illustrated top view of an exemplary hex flex apparatus 100 for resistance training is presented. The hex flex apparatus 100 is useful for providing more than the standard two-dimension experience, in that a standard apparatus requires large jumps in band size and resistance to move up to the next level. The hex flex apparatus 100 further adds a third dimension by allowing for smaller, more gradual increments to resistance, which leased to more and steadier strength progress before reaching a plateau or sticking process.

The hex flex apparatus 100 is preferably seven (7) inches in height, but other heights are contemplated such as, but not limited to eight (8) inches, seven and one-half (7.5) inches, six (6) inches, etc.

The hex flex apparatus 100 is preferably thirty (30) inches in length, but other lengths are contemplated such as, but not limited to twenty-five (25) inches, thirty-five (35) inches, fifty (50) inches, etc.

The hex flex apparatus 100 is preferably eighteen (18) inches in depth, but other depths are contemplated such as, but not limited to fourteen (14) inches, twenty-four (24) inches, etc.

The hex flex apparatus 100 is preferably rectangular in shape but other shapes are contemplated such as, but not limited to, square, trapezoidal, hexagonal, etc.

The hex flex apparatus 100 has a platform 110, a plurality of bands 140, a plurality of rods 126, 127, 128, 129 and a plurality of handle assemblies 120. The platform 110 has a top side 111, a first side 112, a second side 113, a third side 114, a fourth side 115 and a bottom 116.

The platform 110 is preferably made of a metal material, such as steel, aluminum, titanium, etc., but other materials are further contemplated such as, but not limited to, wood, high-density poly-ethylene (HDPE), etc. The platform 110 is preferably rectangular in shape but other shapes are contemplated such as, but not limited to, square, trapezoidal, hexagonal, etc.

The platform 110 is preferably seven (7) inches in height, but other heights are contemplated such as, but not limited to eight (8) inches, seven and one-half (7.5) inches, six (6) inches, etc. The platform 110 is preferably thirty (30) inches in length, but other lengths are contemplated such as, but not limited to twenty-five (25) inches, thirty-five (35) inches, fifty (50) inches, etc. The platform 110 is preferably eighteen (18) inches in depth, but other depths are contemplated such as, but not limited to fourteen (14) inches, twenty-one (21) inches, etc.

The top side 111 of the platform 110 of the hex flex apparatus 100 has a first portion 117, a second portion 118 and a middle portion 119.

The handle assemblies 120 shown in a blow up of the handle assemblies 120 in FIG. 1 has a handle 131 and two hooks 132, 133. The handle assemblies 120 are preferably between seven and one-half and eight (7.5-8) inches in length, however other lengths are hereby contemplated, including, but not limited to, seven (7) inches, eight and one-half (8.5) inches, etc. The handle 131 is preferably between five and one-half and six (5.5-6) inches in length, however other lengths are hereby contemplated, including, but not limited to, four (4) inches, eight (8) inches, etc. The handle 131 is preferably a knurled grip.

The hooks 132, 133 are preferably five and one-half (5.5) inches in width, however other widths are hereby contemplated, including, but not limited to, five (5) inches, six (6) inches, etc. The hooks 132, 133 preferably have a depth of four (4) inches, however other depths are hereby contemplated, including, but not limited to, three (3) inches, six (6) inches, etc. The hooks 132, 133 preferably are configured to hold up to four (4) inch wide bands 140, however other widths are hereby contemplated, including, but not limited to, four and one-half (4.5) inches, five (5) inches, etc.

A first end 134 of a first of the hooks 132 is coupled to a first end 136 of the handle 131. A first end 135 of a second of the hooks 133 is coupled to a second end 137 of the handle 131. The handle assemblies 120 are coupled to the bands 140.

A first of the handle assemblies 120 is removably coupled to the second side 118 of the top side 111 of the platform 110 by one of the bands 140. A second of the handle assemblies 120 is removably coupled to the second side 118 of the top side 111 of the platform 110 by one of the bands 140. The bands 140 are preferably tension bands, in that the bands 140 are stretchable and providing resistance to a user. The resistance of the bands 140, and thus the workout, is determined as described below.

The first side 112 of the platform 110 of the hex flex apparatus 100 has the rod 126 and the rod 127. The rod 126 of the first side 112 and the rod 127 of the first side 112 are useful in providing adjustable tension on a bands 140 for resistance training and thus changing the effort to lift the bands 140. The handle assemblies 120 are removably coupled to the bands 140.

The third side 114 of the platform 110 of the hex flex apparatus 100 has the rod 128 and the rod 129. The rod 128 of the third side 114 and the rod 129 of the third side 114 are useful in providing adjustable tension on a bands 140 for resistance training and thus changing the effort to lift the bands 140 coupled to the handle assemblies 120.

A plurality of ring magnets 130 are configured to securely couple the rods 126, 127, 128, 129 to the desired position to the first side 112 and the third side 114 of the platform 110. The ring magnets 130 are coupled only to a first side 141, 142, 143, 144 of the rods 126, 127, 128, 129 thereby not preventing the ring magnets 130 from preventing insertion of the rods 126, 127, 128, 129 from being inserted through a plurality of holes (206, 207, 208, 209, 210, 211 of FIG. 2).

Figure 2:
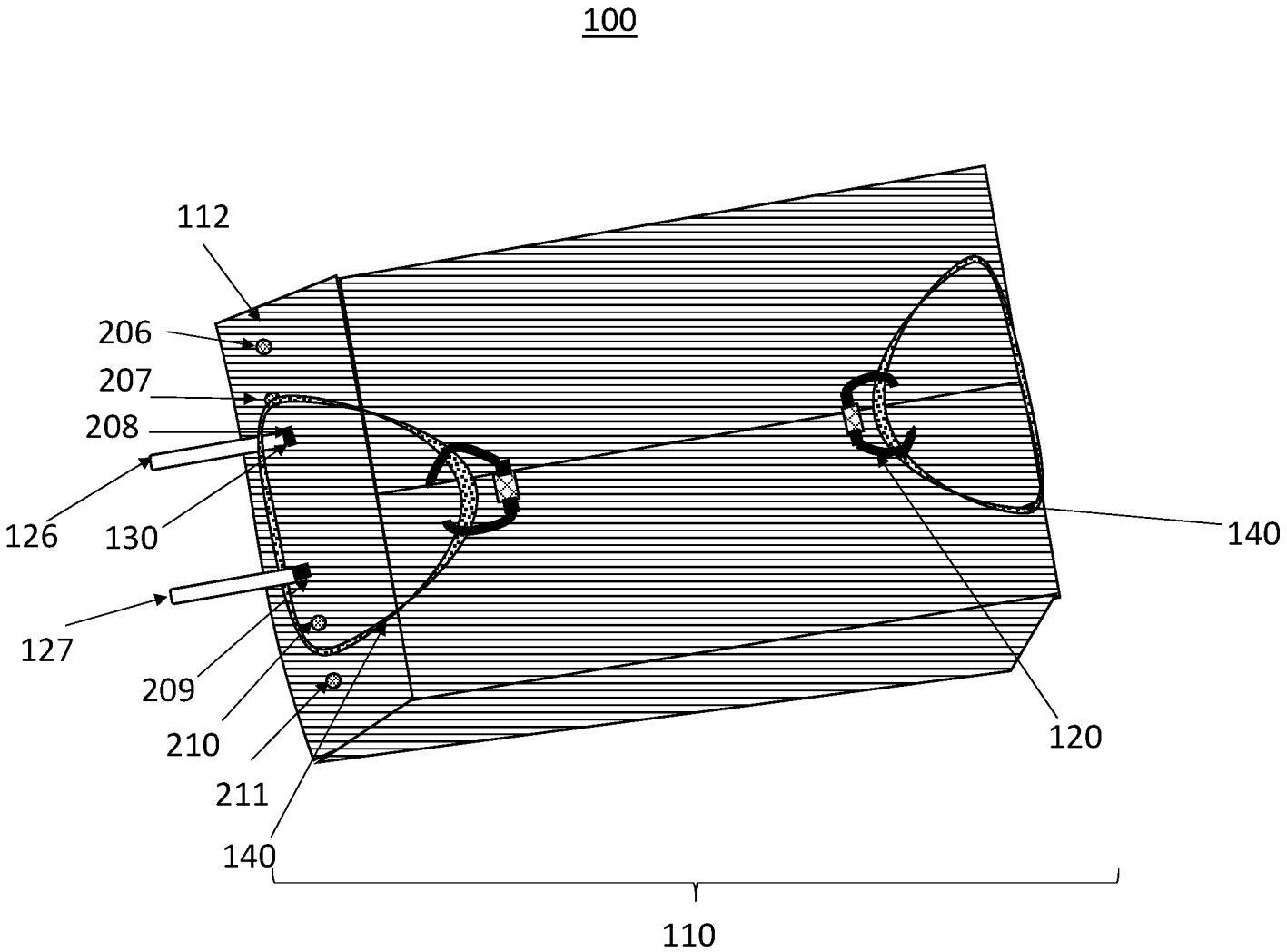
FIG. 2 is an illustrated first side view of the exemplary hex flex apparatus as shown in FIG. 1.

Referring now to FIG. 2, an illustrated side view of the exemplary hex flex apparatus 100 as shown in FIG. 1 is presented.

The plurality of handle assemblies 120 is removably coupled to the bands 140 and the bands 140.

The first side 112 of the platform 110 of the hex flex apparatus 100 has the rods 126, 127. The rod 126 of the first side 112 and the rod 127 of the first side 112 are useful in providing adjustable tension on a band (not shown) for weight lifting and thus changing the effort to extend the bands 140.

The rods 126, 127, 128, 129 are preferably forty-four (44) inches in length, but other lengths apart have been contemplated, including, but not limited to, forty (40) inches, forty-eight (48) inches, etc.

The first side 112 has a plurality of holes 206, 207, 208, 209, 210, 211. The holes 206, 207, 208, 209, 210, 211 preferably have a diameter being one (1) inch, however other diameters are hereby contemplated, including, but not limited to, one-half (0.5) inch, two (2) inches, etc. The holes 206, 207, 208, 209, 210, 211 are preferably one (1) inch apart, but other lengths apart have been contemplated, including, but not limited to, two (2) inches, one-half (0.5) inch, etc.

The plurality of holes 206, 207, 208, 209, 210, 211 provide a progression of tension and workout effort necessary for resistance training. The plurality of holes 206, 207, 208, 209, 210, 211 is preferably twelve (12) in number however other number of holes are contemplated such as, but not limited to, six (6), sixteen (16), etc. The plurality of holes 206, 207, 208, 209, 210, 211 preferably being in groups of six (6). The greater the number of holes the step up in the resistance is lessened and progress may be easier to obtain. The plurality of holes 206, 207, 208, 209, 210, 211.

The rod 126 is coupled to the hole 208 and is configured to be stable in location by the ring magnet 130. The rod 127 is coupled to the hole 209 and is configured to be stable in location by the ring magnet 130. The hole 208 and the hole 209 provide the least resistance when utilizing the bands 140 in resistance training. The rod 127 and the rod 128 are preferably steel, but may be other types of metal.

Figure 3:
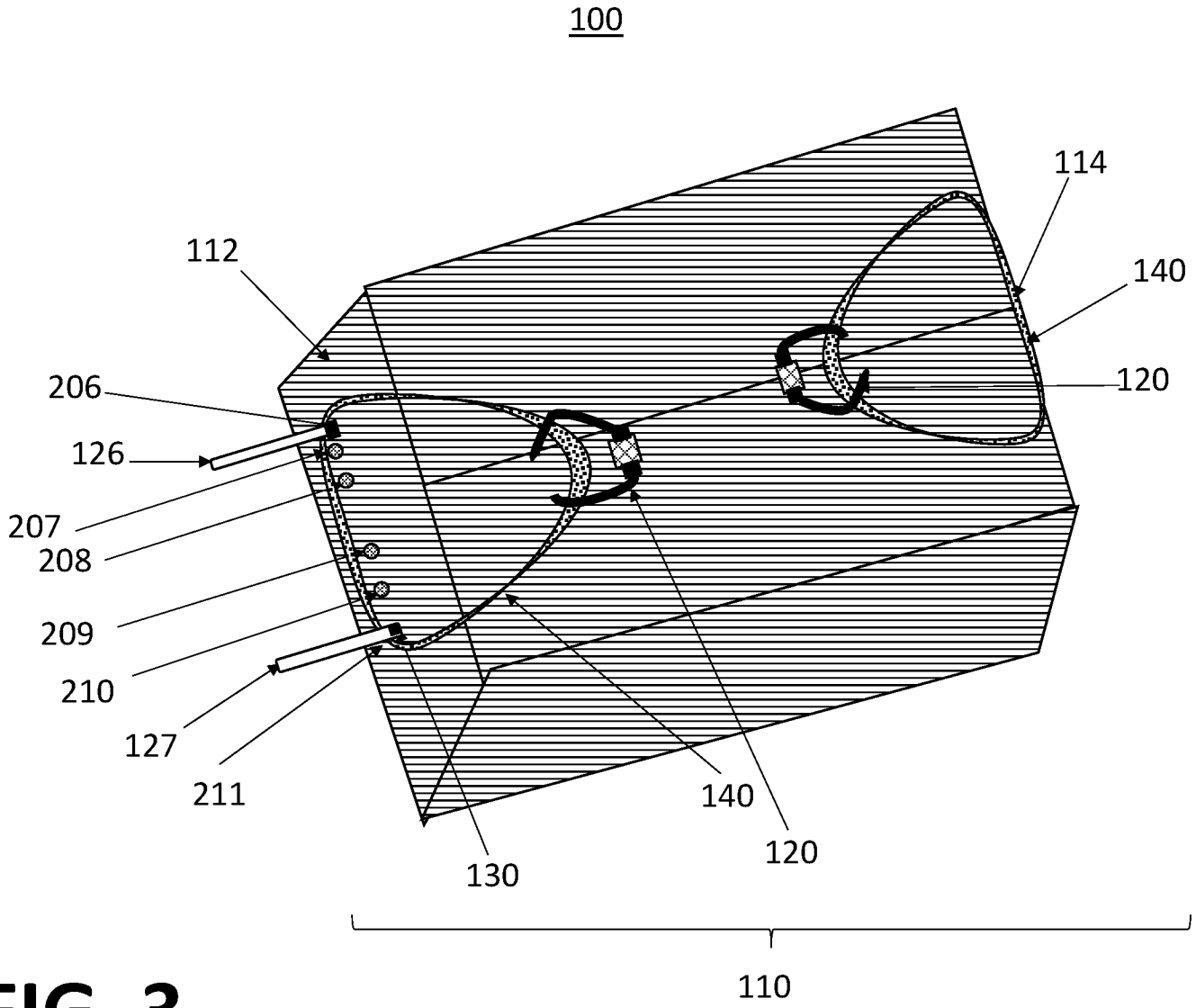
FIG. 3 is an illustrated second side view of the exemplary hex flex apparatus as shown in FIG. 1.

In FIG. 3 an illustrated second side view of the exemplary hex flex apparatus as shown in FIG. 2 is shown. The main affect of the changes described herein is the increase in tension by moving the rods 126, 127 to increase tension and intensity of the resistance training. Thus, the description will only describe the changes from FIG. 2.

The bands 140 coupled to the handle assemblies 120 of the platform 110. The rod 126 has been moved from hole 208 to hole 206. The rod 127 has been repositioned from hole 209 to hole 211. Thus, when in use the band 140 is wider at the rod 126 and the rod 127 causing the tension to increase and intensity of the resistance training to increase. The same conditions would be operable for the third side 114 of the platform 110 although not shown The handle assemblies 120 are coupled to the bands 140. The bands 140 being removably coupled to the rods 126, 127, the same conditions would be operable for the third side 114 of the platform 110 although not shown.

Optionally and/or additionally, the device 100 may have a double loop, therefore the resistance bands 140 can be placed entirely under the rods 126, 127 and the resistance bands 140 may then be coupled to the handle assembly hooks 120. This option doubles the available resistance from the bands 140 from the embodiment shown in FIGS. 1-3. And also increases available range of motion in exercises that can be done on the device 100 compared to the device shown in FIG. 1-3.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A hex flex apparatus for providing resistance control while resistance training, the apparatus comprising:

a platform, the platform comprising:

a top side;

a first side having a plurality of holes;

a second side;

a fourth side; and a third side having a plurality of holes;

a plurality of rods, wherein a ring magnet is coupled to each of the rods;

a plurality of handle assemblies, each of the handle assemblies having a handle and two hooks, wherein a first of the hooks is coupled to a first end of the handle, and wherein a second of the hooks is coupled to a second end of the handle; and a plurality of bands, the bands being for applying tension to the resistance training, wherein the bands are removably coupled to more than one of the rods.

2. The apparatus of claim 1, wherein the platform is made of a steel material.

3. The apparatus of claim 1, wherein the plurality of rods are removable from the holes.

4. The apparatus of claim 1, wherein the apparatus has a height of seven (7) inches.

5. The apparatus of claim 1, the apparatus having a length of thirty (30) inches.

6. The apparatus of claim 1, the apparatus having a width of eighteen (18) inches.

7. The apparatus of claim 1, wherein each of the rods has a length of forty-four (44) inches.

8. The apparatus of claim 1, wherein the holes have a diameter of one (1) inch.

9. The apparatus of claim 1, wherein the each of the holes of the plurality of holes is a distance of one (1) inch from another of the holes.

10. The apparatus of claim 1, the platform having a total of twelve (12) holes.

11. The apparatus of claim 10, wherein the holes are arranged in groups of six (6) holes.

12. The apparatus of claim 1, wherein the handle has a length in a range of between five and one-half and six (5.5-6) inches.

13. The apparatus of claim 1, wherein each of the hooks has a width of five and one-half (5.5) inches.

14. The apparatus of claim 1, wherein each of the hooks has a depth of four (4) inches.

15. The apparatus of claim 1, wherein the hooks are configured to accommodate a band of a width of up to four (4) inches.

16. The apparatus of claim 1, wherein each of the holes are configured to cause a different tension on the band.

17. The apparatus of claim 1, wherein the rods are made of a steel material.

18. The apparatus of claim 1, wherein the bands are made of a stretchable material.

19. The apparatus of claim 1, wherein the bands are tension bands.

20. The apparatus of claim 1, wherein the handle has a knurled grip.

* * * * *